US010324407B2

(12) United States Patent
Ohta et al.

(10) Patent No.: US 10,324,407 B2
(45) Date of Patent: Jun. 18, 2019

(54) IMAGE FORMING APPARATUS

(71) Applicant: CANON KABUSHIKI KAISHA, Tokyo (JP)

(72) Inventors: Yuya Ohta, Abiko (JP); Noriaki Matsui, Kashiwa (JP); Nozomi Kumakura, Toride (JP); Naoka Omura, Matsudo (JP); Junichiro Nakabayashi, Kashiwa (JP); Takayuki Inoue, Matsudo (JP); Kiyoharu Kakomura, Nagareyama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/643,604

(22) Filed: Jul. 7, 2017

(65) Prior Publication Data

US 2018/0017923 A1 Jan. 18, 2018

(30) Foreign Application Priority Data

Jul. 12, 2016 (JP) ..... 2016-137227

(51) Int. Cl.
*G03G 15/00* (2006.01)

(52) U.S. Cl.
CPC ..... *G03G 15/556* (2013.01)

(58) Field of Classification Search
CPC ..... G03G 15/556
See application file for complete search history.

(56) References Cited

U.S. PATENT DOCUMENTS 5,930,001 A 7/1999 Satoh et al.
6,559,876 B2 5/2003 Kitajima et al.
8,988,728 B2 3/2015 Nakase
9,268,279 B1 * 2/2016 Murayama ..... G03G 15/5058
9,459,579 B2 * 10/2016 Shirafuji ..... G03G 15/5058
10,061,249 B2 8/2018 Oka et al.
2011/0109920 A1 5/2011 Nakase
(Continued)

FOREIGN PATENT DOCUMENTS

CN 104765255 A 7/2015
CN 106062640 A 10/2016
(Continued)

OTHER PUBLICATIONS

Feb. 2, 2019 Chinese Official Action in Chinese Patent Appln. No. 201710548757.8.

*Primary Examiner* — Gregory H Curran
(74) *Attorney, Agent, or Firm* — Venable LLP

(57) ABSTRACT

A controller of an image forming apparatus calculates a density difference between a measurement result of a toner image having the highest density formed on a photosensitive drum, which is obtained by an image density sensor, and the highest density of a density target. When the density difference falls within a predetermined range, the controller generates a tone correction table based on a density value of a first toner image formed with a plurality of densities including the highest density, and sets, based on the density difference, an exposure amount of laser light to be applied to the photosensitive drum by an exposure device. When the density difference falls out of the predetermined range, the controller generates the tone correction table based on a density value of a second toner image having a larger number of tone levels than that of the first toner image.

11 Claims, 11 Drawing Sheets

(56) References Cited

U.S. PATENT DOCUMENTS

| | | | | |
|---|---|---|---|---|
| 2015/0168901 | A1* | 6/2015 | Yasuda | G03G 15/55 399/72 |
| 2016/0077458 | A1 | 3/2016 | Shirafuji | |
| 2016/0327896 | A1 | 11/2016 | Oka et al. | |

FOREIGN PATENT DOCUMENTS

| | | | |
|---|---|---|---|
| JP | 2015-197470 | A | 11/2015 |
| JP | 2016-048288 | A | 4/2016 |
| JP | 2016-061924 | A | 4/2016 |

* cited by examiner

IMAGE FORMING APPARATUS

BACKGROUND OF THE INVENTION

Field of the Invention

The present invention relates to an image forming apparatus, for example, a copying machine, a laser beam printer, or a multifunction printer.

Description of the Related Art

In regard to an image forming apparatus, there is a high demand for a direct image printer that eliminates a need for a plate used for offset printing or the like. The direct image printer is capable of handling reduction in time required for printing, service for each individual customer, printing of an enormous number of copies, an environmental issue that paper is discarded due to a failure in printing, or the like. Of the direct image printers, there are particularly often employed: an inkjet printer, which is advantageous in terms of price and suitable for photographic printing; and an electrophotographic printer, which is high in productivity, and exhibits a finish that is close to that of the offset printing. Such an image forming apparatus is required to exhibit stability in colors of a formed image.

In order to ensure the stability in colors, there is a technology for conducting the color stabilization control inside the image forming apparatus without a manual operation. For example, an image forming apparatus described in U.S. Pat. No. 6,559,876 is configured to detect a density of a toner-density-detecting image formed on a photosensitive member using a sensor to adjust an exposure amount for exposing the photosensitive member based on a result of detecting the density, and to change a correction amount for tone correction corresponding to a variation of a halftone density. An image forming apparatus described in Japanese Patent Application Laid-open No. 2015-197470 is configured to adjust the exposure amount based on a result of detecting the density of the toner-density-detecting image formed with the highest density, to thereby conduct the tone correction for a period of time shorter than in the case of the related art.

In the case of adjusting the exposure amount using the toner-density-detecting image having the highest density, the exposure amount cannot be greatly changed at once due to an influence of density variations in a highlighted portion of the toner-density-detecting image. This is because the influence of density deviation in the highlighted portion becomes larger when the exposure amount is greatly changed at once, which inhibits the correction amount for the tone correction from being changed in time. Therefore, for example, in a case where there is a great change in environment at a time of image formation, the adjustment of the exposure amount and the change of the correction amount for the tone correction may fail to follow the density variations, which may produce a resultant object having a much different density. In view of the foregoing, there is a demand for an image forming apparatus capable of suitably adjusting a density while following even great environmental variations.

SUMMARY OF THE INVENTION

An image forming apparatus according to the present disclosure includes: a converter configured to convert image data based on a conversion condition; an image forming unit configured to form an image on a sheet based on the image data converted by the converter; a measuring unit configured to measure a measurement image on an image bearing member; and a controller configured to: control the image forming unit to form a first measurement image on the image bearing member; control the measuring unit to measure the first measurement image; adjust, based on a measurement result of the first measurement image, an image forming condition for adjusting a density of the image to be formed on the sheet by the image forming unit; control the image forming unit to form second measurement images on the image bearing member; control the measuring unit to measure the second measurement images; and generate the conversion condition based on measurement results of the second measurement images, control the image forming unit to form a third measurement image on the image bearing member; control the measuring unit to measure the third measurement image; and control whether or not to form the first measurement image and the second measurement images based on a measurement result of the third measurement image.

Further features of the present invention will become apparent from the following description of exemplary embodiments (with reference to the attached drawings).

DESCRIPTION OF THE EMBODIMENTS

Now, an embodiment of the present invention is described below in detail with reference to the drawings.

Figure 1:
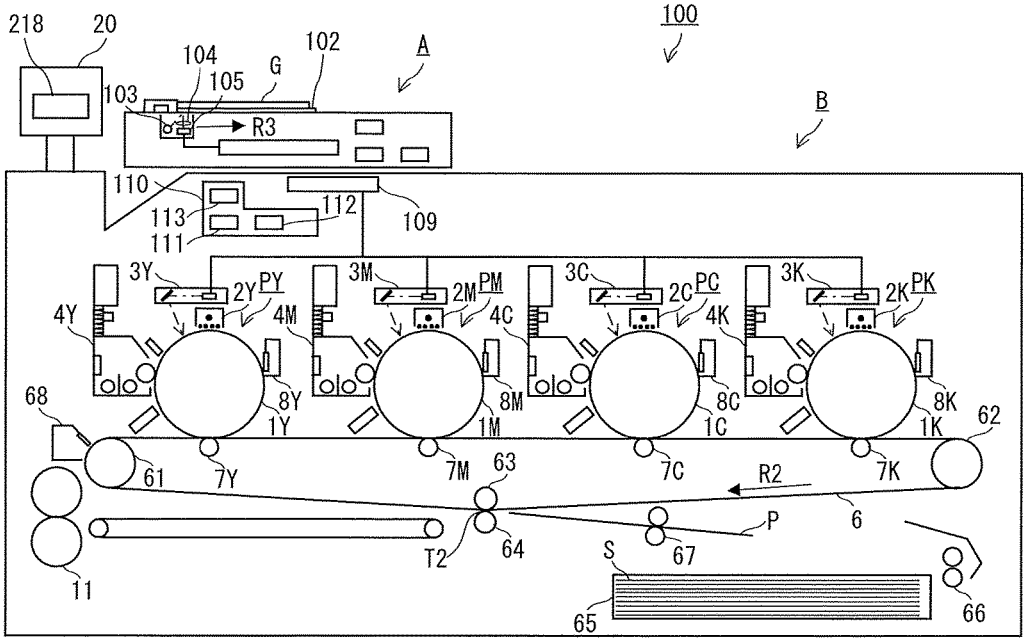
FIG. 1 is a configuration diagram of an image forming apparatus.

FIG. 1 is a configuration diagram of an image forming apparatus according to this embodiment. An image forming apparatus 100 includes an operation unit 20, a reader A configured to read an image from an original G, and a printer section B configured to conduct image forming processing. The operation unit 20 is a user interface, and includes an input device including various input buttons and a numeric keypad and an output device including a display 218. The display 218 may be a touch panel display. A user can input a type of the image, the number of sheets to be subjected to image formation, and other such conditions to the image forming apparatus 100 through the operation unit 20.

Reader

The reader A includes an original table 102 on which the original G is to be placed. In order to read an image from the original G on the original table 102, the reader A includes a light source 103, an optical system 104, and a reading sensor 105. The light source 103 is configured to irradiate the original G with light. The applied light is reflected by the original G. The optical system 104 includes a lens and other components, and is configured to image the light reflected by the original G onto a light-receiving surface of the reading sensor 105. The reading sensor 105 is, for example, a charge-coupled device (CCD) sensor, and is configured to receive the reflected light imaged on the light-receiving surface. The reader A is configured to generate image data representing an image of the original G based on the reflected light received by the reading sensor 105, and to transmit the generated image data to the printer section B. The light source 103, the optical system 104, and the reading sensor 105 are integrally formed, and are configured to move toward a direction indicated by an arrow R3. With this configuration, an image on the entire surface of the original G is read.

Printer Section

The printer section B is configured to acquire the image data from the reader A, and to conduct the image forming processing based on the image data. The printer section B may be configured to acquire the image data to be used for the image forming processing not only from the reader A but also from an external apparatus through a telephone line or a network.

The printer section B includes an image forming unit PY configured to form a toner image of yellow, an image forming unit PM configured to form a toner image of magenta, an image forming unit PC configured to form a toner image of cyan, and an image forming unit PK configured to form a toner image of black. The letters Y, M, C, and K at the end of the reference symbols represent yellow, magenta, cyan, and black, respectively. In the following, in a case where there is no need to distinguish the colors, the description is given without adding the letters Y, M, C, and K to the end of the reference symbols. The same also applies to other components provided for each of the colors. In addition, the printer section B includes exposure devices 3Y, 3M, 3C, and 3K, an intermediate transfer belt 6, a fixing device 11, and a conveying mechanism for conveying a recording material S. The exposure devices 3Y, 3M, 3C, and 3K are provided so as to correspond to the image forming units PY, PM, PC, and PK, respectively. The printer section B is a full-color printer employing a tandem-type intermediate transfer system in which the image forming units PY, PM, PC, and PK are arranged along the intermediate transfer belt 6.

The image forming units PY, PM, PC, and PK have the same configuration. The following description is directed to the configuration of the image forming unit PY, and descriptions of the configurations of the other image forming units PM, PC, and PK are omitted. The image forming unit PY includes a photosensitive drum 1Y, a charger 2Y, a developing device 4Y, a primary transfer roller 7Y, and a drum cleaner 8Y. The photosensitive drum 1Y is configured to be irradiated with laser light by the corresponding exposure device 3Y after having a surface charged by the charger 2Y, to thereby have an electrostatic latent image formed thereon. The electrostatic latent image is developed by the developing device 4Y. With this configuration, the toner image of yellow is formed on the photosensitive drum 1Y. The primary transfer roller 7Y is arranged at a position opposed to the photosensitive drum 1Y across the intermediate transfer belt 6. The primary transfer roller 7Y is configured to transfer the toner image formed on the photosensitive drum 1Y onto the intermediate transfer belt 6. The toner remaining on the photosensitive drum 1Y is removed by the drum cleaner 8Y after the transferring.

The exposure device 3Y includes a rotary mirror. The exposure device 3Y is configured to scan the photosensitive drum 1Y by deflecting the laser light modulated based on the image data representing an image of yellow in accordance with the rotation of the rotary mirror. With this configuration, the electrostatic latent image representing the image based on the image data of yellow is formed on the photosensitive drum 1Y.

In the same manner, a toner image of magenta is formed on a photosensitive drum 1M of the image forming unit PM. The toner image of magenta is transferred from the photosensitive drum 1M onto the intermediate transfer belt 6 by a primary transfer roller 7M. A toner image of cyan is formed on a photosensitive drum 1C of the image forming unit PC. The toner image of cyan is transferred from the photosensitive drum 1C onto the intermediate transfer belt 6 by a primary transfer roller 7C. A toner image of black is formed on a photosensitive drum 1K of the image forming unit PK. The toner image of black is transferred from the photosensitive drum 1K onto the intermediate transfer belt 6 by a primary transfer roller 7K. The toner images of the respective colors are transferred onto the intermediate transfer belt 6 in order one over another.

The intermediate transfer belt 6 is supported by being stretched around a tension roller 61, a drive roller 62, and an opposing roller 63. In addition, a belt cleaner 68 is provided in the vicinity of the intermediate transfer belt 6. The intermediate transfer belt 6 is driven by the drive roller 62 to be rotated in a direction indicated by an arrow R2 at a predetermined process speed. The toner images of the respective colors which have been transferred onto the intermediate transfer belt 6 are conveyed to a secondary transfer portion T2 by the rotation of the intermediate transfer belt 6. The secondary transfer portion T2 is formed between a secondary transfer roller 64 and the opposing roller 63. At the secondary transfer portion T2, the toner images of all the colors are collectively transferred from the intermediate transfer belt 6 onto the recording material S, for example, a sheet, with the intermediate transfer belt 6 and the recording material S being sandwiched between the secondary transfer roller 64 and the opposing roller 63. When a DC voltage having a positive polarity is applied to the secondary transfer roller 64, a toner image charged to a negative polarity is transferred from the intermediate transfer belt 6 onto the recording material S. After the transfer, the toner remaining on the intermediate transfer belt 6 is removed by the belt cleaner 68.

The recording materials S are received in a sheet feeding cassette 65, and are conveyed to the secondary transfer portion T2 by the conveying mechanism sheet by sheet. The conveying mechanism includes separation rollers 66 and registration rollers 67. The separation rollers 66 are configured to convey the recording materials S from the sheet feeding cassette 65 to the registration rollers 67 sheet by sheet. The registration rollers 67 are configured to correct skew feeding or the like of the recording material S, and to convey the recording material S so that the recording material S reaches the secondary transfer portion T2 at the same timing as a timing at which the toner images formed on the intermediate transfer belt 6 are conveyed to reach the secondary transfer portion T2.

The recording material S having the toner images transferred thereon at the secondary transfer portion T2 are conveyed to the fixing device 11. The fixing device 11 is configured to fix the toner images to the recording material S by heating and pressurizing the recording material S having the toner images transferred thereon. In this manner, the image is formed on the recording material S. The recording material S on which the image based on the image data has been formed is delivered to the outside of the printer section B.

Image Forming Unit

Figure 2:
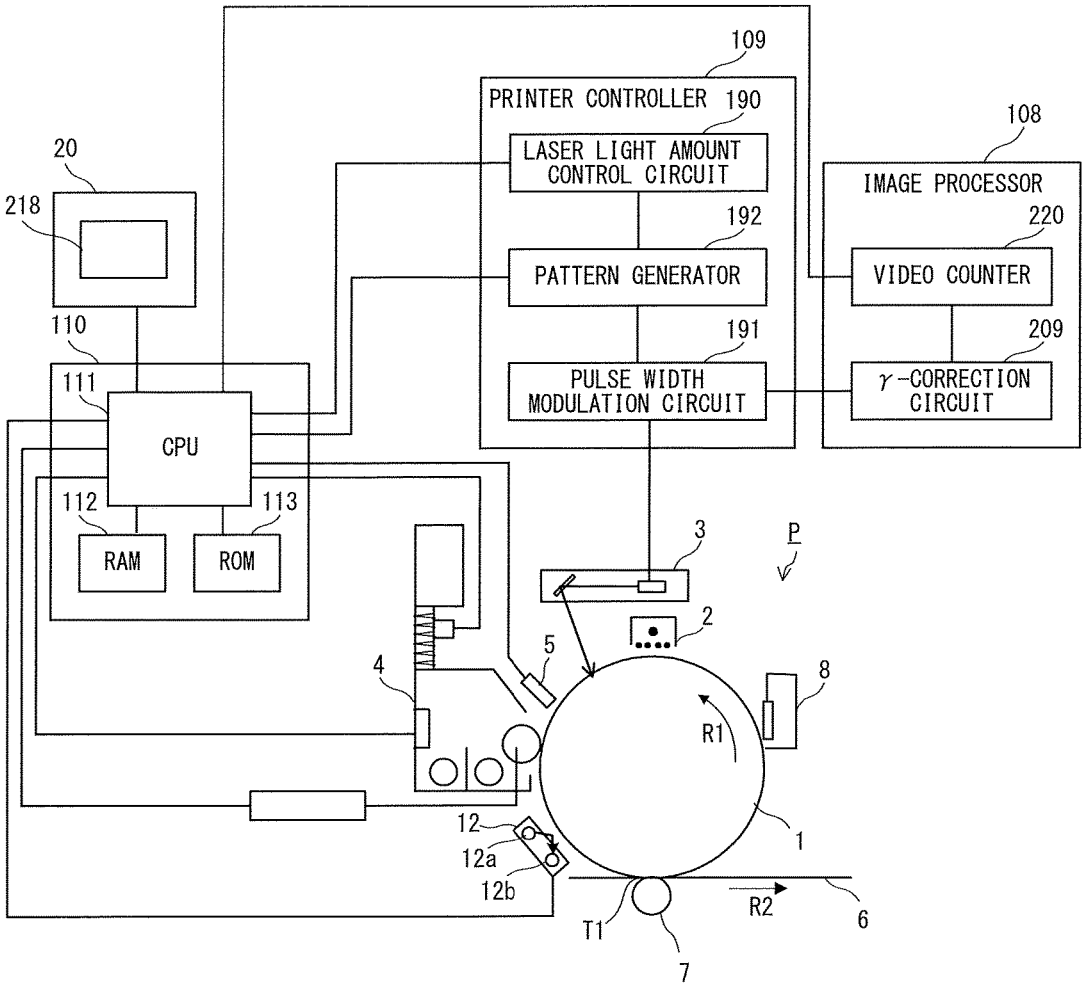
FIG. 2 is an explanatory diagram of an image forming unit.

FIG. 2 is an explanatory diagram of the image forming unit P.

The photosensitive drum 1 is an image bearing member formed of, for example, an electrophotographic photosensitive member of a rotary drum type. The photosensitive drum 1 is rotationally driven in a direction indicated by an arrow R1 at a predetermined process speed. The charger 2 is, for example, a scorotron charger, and is configured to charge the surface of the photosensitive drum 1 to a uniform potential having a negative polarity. The scorotron charger includes a wire to which a high voltage is applied, a shield portion connected to the ground, and a grid portion to which a desired voltage is applied. A predetermined charging bias is applied to the wire from a charging bias power supply (not shown). A predetermined grid bias is applied to the grid portion from a grid bias power supply (not shown). The photosensitive drum 1 is charged to almost the same potential as a potential applied to the grid portion, which depends on the voltage applied to the wire.

The photosensitive drum 1 has the electrostatic latent image formed in a part irradiated with the laser light by the exposure device 3. The developing device 4 is configured to visualize the electrostatic latent image formed on the photosensitive drum 1 as the toner image by supplying a developer thereto. In the vicinity of the photosensitive drum 1, a potential sensor 5 is provided between a position of exposure by the exposure device 3 and the developing device 4. The potential sensor 5 is configured to detect a potential of the electrostatic latent image.

The primary transfer roller 7 is configured to press an inner surface of the intermediate transfer belt 6 against the photosensitive drum 1 side, and to form a primary transfer portion T1 between the photosensitive drum 1 and the intermediate transfer belt 6. When the DC voltage having a positive polarity is applied to the primary transfer roller 7, the negative-polarity toner image formed on the photosensitive drum 1 is transferred onto the intermediate transfer belt 6 passing through the primary transfer portion T1. In the vicinity of the photosensitive drum 1, an image density sensor 12 is provided between the developing device 4 and the primary transfer portion T1. The image density sensor 12 is configured to detect a density of the toner image formed on the photosensitive drum 1.

Control System

The image forming apparatus 100 includes, as a control system, a controller 110, a printer controller 109, and an image processor 108. The controller 110 is configured to control an operation of the image forming apparatus 100. The printer controller 109 is configured to control an operation of the exposure device 3 based on a processing result obtained by the image processor 108. Such a control system is built into the printer section B.

The controller 110 is a computer including a central processing unit (CPU) 111, a random access memory (RAM) 112, and a read only memory (ROM) 113. The CPU 111 is configured to read a computer program from the ROM 113, and to execute the computer program with the RAM 112 being used as a work area, to thereby control image reading processing conducted by the reader A of the image forming apparatus 100 and the image forming processing conducted by the printer section B of the image forming apparatus 100. The controller 110 is connected to the operation unit 20, and is configured to receive various kinds of input from the operation unit 20 and to cause the image reading processing and the image forming processing to be executed. The controller 110 is further configured to cause the display 218 to display a setting screen or the like.

The controller 110 can set a plurality of process speeds for the image forming processing. For example, the controller 110 switches the process speed (image forming speed) depending on a basis weight of the recording material S received in the sheet feeding cassette 65. In this embodiment, two types of process speeds (image forming speeds) can be set between 300 mm/s (constant-speed mode) to be set when the basis weight of the recording material S is smaller than 200 g/m$^2$ and 150 mm/s (low-speed mode) to be set when the basis weight is equal to or larger than 200 g/m$^2$. The process speed (image forming speed) is relatively lower in the low-speed mode than in the constant-speed mode. The driving speeds of the photosensitive drum 1 and the intermediate transfer belt 6, a charging voltage of the charger 2, an exposure amount of the laser light applied by the exposure device 3, a voltage applied at the primary transfer portion T1, and other conditions are set based on the process speed.

The printer controller 109 includes a laser light amount control circuit 190, a pattern generator 192, and a pulse width modulation circuit 191. The printer controller 109 is connected to the image processor 108 configured to conduct the image processing on the image data representing the image to be formed. The image processor 108 includes a video counter 220 and a γ-correction circuit 209, and is configured to conduct the image processing, for example, gamma correction, on the image to be formed.

The printer controller 109 is configured to transmit, to the exposure device 3, a laser drive signal for controlling a light amount, a light-emitting timing, or the like of the laser light. The laser light amount control circuit 190 is configured to determine the light amount of the laser light to be output from the exposure device 3 so that a suitable image density is obtained from the laser drive signal. The light amount of the laser light is an example of an image forming condition. The pattern generator 192 is configured to hold image data for forming toner-density-detecting images being measurement images described later. The pulse width modulation circuit 191 is configured to generate a binary laser drive signal with a pulse width determined based on the drive signal generated using a correction value (tone correction table) for tone correction which is held by the γ-correction circuit 209. The γ-correction circuit 209 functions as a converter configured to convert the image data based on the tone correction table.

The tone correction table is a gamma look-up table (LUT) for converting the image data so that a density characteristic (tone characteristic) of the image becomes an ideal density characteristic (ideal tone characteristic). The tone correction table provides a conversion condition for converting the image data in order to correct the tone characteristic (density characteristic) of the image formed by the image forming unit P. In another case, the tone correction table provides a tone correction condition for correcting the tone characteristic (density characteristic) of the image formed by the image forming unit P. The pulse width modulation circuit 191 is configured to generate the laser drive signal with the light amount determined by the laser light amount control circuit 190 and using the image data converted based on the tone correction table. The laser drive signal is a pulse width modulation (PWM) signal, and is used to modulate the laser light to be emitted from the exposure device 3.

That is, the printer controller 109 is configured to cause the pulse width modulation circuit 191 to output the laser drive signal being a pulse signal having a pulse width (time width) corresponding to the density for each pixel of the input image data. The laser drive signal has a large pulse width for a pixel having a high density, has a small pulse width for a pixel having a low density, and has a medium pulse width for a pixel having a medium density.

The exposure device 3 is configured to form an image having a density tone through area coverage modulation based on the pulse width of the laser drive signal. The exposure device 3 is configured to cause a laser light source, for example, a built-in semiconductor laser, to emit light for a time period corresponding to the pulse width of the laser drive signal. The laser light source is driven for a long time period at a time of forming the pixel having a high density, and is driven for a short time period at a time of forming the pixel having a low density. Therefore, a dot size of the electrostatic latent image formed on the photosensitive drum 1 has a different area depending on a pixel density. The exposure device 3 is configured to expose a range that is long in a main scanning direction at the time of forming the pixel having a high density, and to expose a range that is short in the main scanning direction at the time of forming the pixel having a low density.

Image Density Sensor

The image density sensor 12 is a photosensor configured to detect the density of the toner image formed on the photosensitive drum 1. The image density sensor 12 includes a light emitter 12*a* formed of a light emitting diode (LED) or other such light-emitting element and a light receiver 12*b* formed of a photodiode or other such light-receiving element. The light emitter 12*a* is configured to irradiate the surface of the photosensitive drum 1. The light receiver 12*b* is configured to receive specularly reflected light of the light emitted from the light emitter 12*a*, which is specularly reflected by the photosensitive drum 1. The light receiver 12*b* is configured to measure an amount of the specularly reflected light. The image density sensor 12 is configured to measure the amount of the light reflected by the photosensitive drum 1 at a timing at which the toner-density-detecting image being the toner image formed on the photosensitive drum 1 passes through a detection region. The image density sensor 12 is configured to transmit a measurement result to the CPU 111 of the controller 110.

Figure 3:
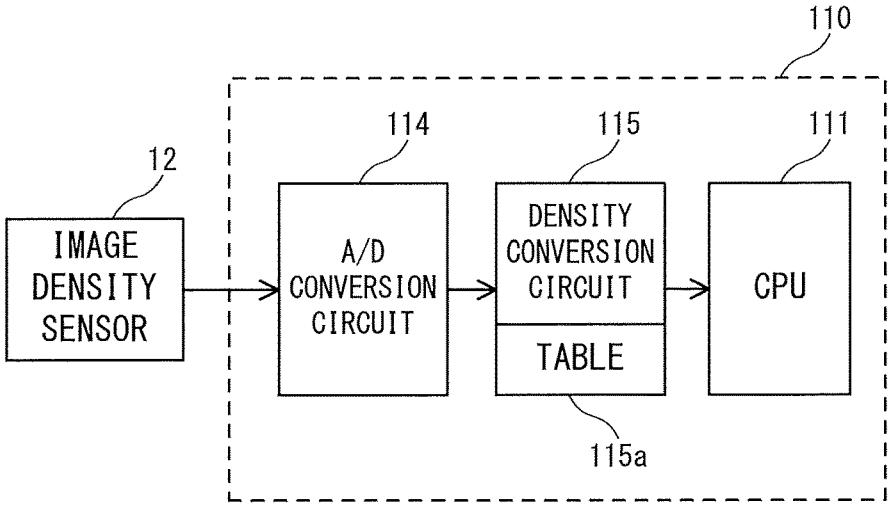
FIG. 3 is a block diagram of a controller.

FIG. 3 is a block diagram of the controller 110 configured to receive the measurement result obtained by the image density sensor 12. The light receiver 12*b* of the image density sensor 12 is configured to transmit an analog electric signal corresponding to the amount of the received reflected light to the controller 110 as the measurement result. The analog electric signal is expressed by, for example, a voltage value of from 0 V to 5 V. The controller 110 includes an A/D conversion circuit 114 and a density conversion circuit 115 between the image density sensor 12 and the CPU 111. The density conversion circuit 115 is configured to hold a table 115*a*, which is used to convert the measurement result obtained by the image density sensor into a density value, for each color based on a characteristic of the image density sensor 12.

The A/D conversion circuit 114 is configured to convert the analog electric signal acquired from the image density sensor 12 into an 8-bit digital signal. The density conversion circuit 115 is configured to convert the digital signal obtained through the conversion conducted by the A/D conversion circuit 114 into the density value with reference to the table 115*a*. The density conversion circuit 115 is configured to input the density value obtained through the conversion to the CPU 111.

Figure 4:
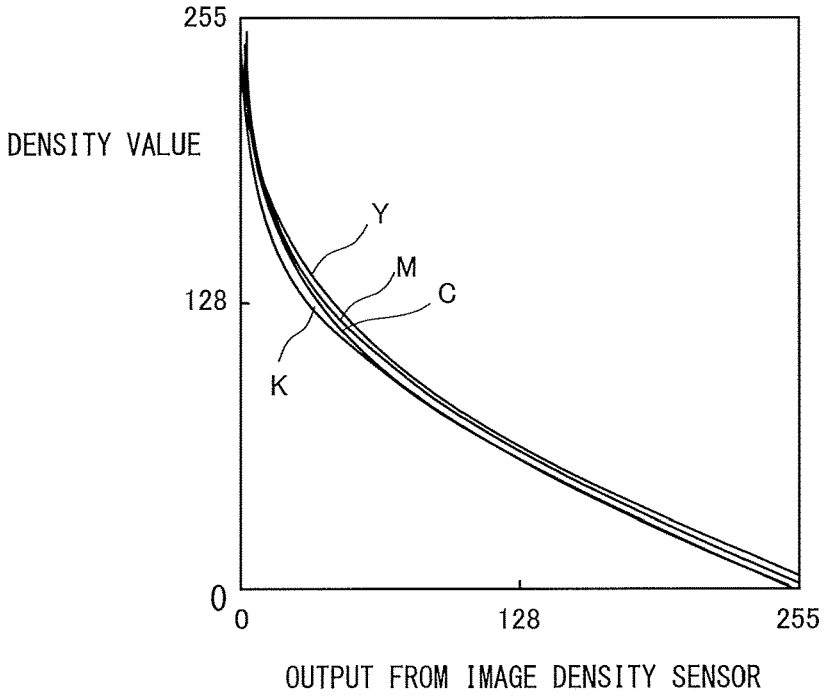
FIG. 4 is an explanatory graph of a table.

FIG. 4 is an explanatory graph of the table 115*a*. When the density of the toner-density-detecting image formed on the photosensitive drum 1 is changed stepwise through the area coverage modulation, the measurement result obtained by the image density sensor 12 changes in accordance with the stepwise change. In this case, the measurement result obtained by the image density sensor 12 when a toner does not adhere to the photosensitive drum 1 is 5 V, and the density is expressed by a density value having 255 levels. As the image density becomes higher due to an increase in area coverage ratio of the pixel formed on the photosensitive drum 1 to be covered with the toner, the measurement result (analog electric signal) obtained by the image density sensor 12 becomes smaller. The density conversion circuit 115 can accurately convert the measurement result obtained by the image density sensor 12 into the density value of each color with reference to the table 115*a* indicating such a relationship as shown in FIG. 4.

Toner-Density-Detecting Image

Figure 5A:
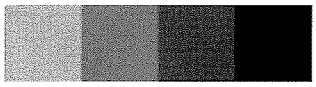
FIG. 5A and FIG. 5B are diagrams for exemplifying a toner-density-detecting image.
Figure 5B:
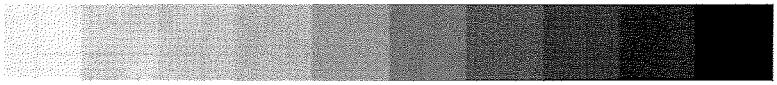

FIG. 5A and FIG. 5B are diagrams for exemplifying the toner-density-detecting image. FIG. 5A is a diagram for exemplifying the toner-density-detecting image including a halftone portion within a predetermined number of tone levels, for example, three tone levels, and a Dmax portion (highest-density portion) having the highest density. FIG. 5B is a diagram for exemplifying the toner-density-detecting image within a larger number of tone levels (ten tone levels) than in FIG. 5A. The image forming unit P is configured to form the toner-density-detecting image being such a toner image on the photosensitive drum 1 under the control of the controller 110 and the printer controller 109. The controller 110 is configured to execute image density control processing described later so that the density of the toner-density-detecting image converges within a range of a reference density based on the measurement result of the density of the toner-density-detecting image obtained by the image density sensor 12.

The printer controller 109 is configured to acquire image data representing the toner-density-detecting image from the pattern generator 192, and to control the operation of the exposure device 3. The image data is data to be used for forming the toner-density-detecting image with a predetermined image density. The pulse width modulation circuit 191 is configured to generate the laser drive signal having a pulse width corresponding to the predetermined image density based on the image data representing the toner-density-detecting image which is acquired from the pattern generator 192. The pulse width modulation circuit 191 is configured to supply the generated laser drive signal to the exposure device 3. The exposure device 3 is configured to emit the light of the semiconductor laser for a time period corresponding to the pulse width of the laser drive signal to scan the photosensitive drum 1. With this configuration, the electrostatic latent image of the toner-density-detecting image corresponding to a predetermined density is formed on the photosensitive drum 1. When the electrostatic latent image is developed by the developing device 4, the toner image of the toner-density-detecting image is formed on the photosensitive drum 1.

Image Density Control Processing

The image density control processing includes tone correction processing, processing for increasing or decreasing the exposure amount, and processing for resetting the exposure amount and the tone correction table. The image density control processing is conducted for each of the colors of yellow, magenta, cyan, and black.

Tone Correction Processing

Figure 6:
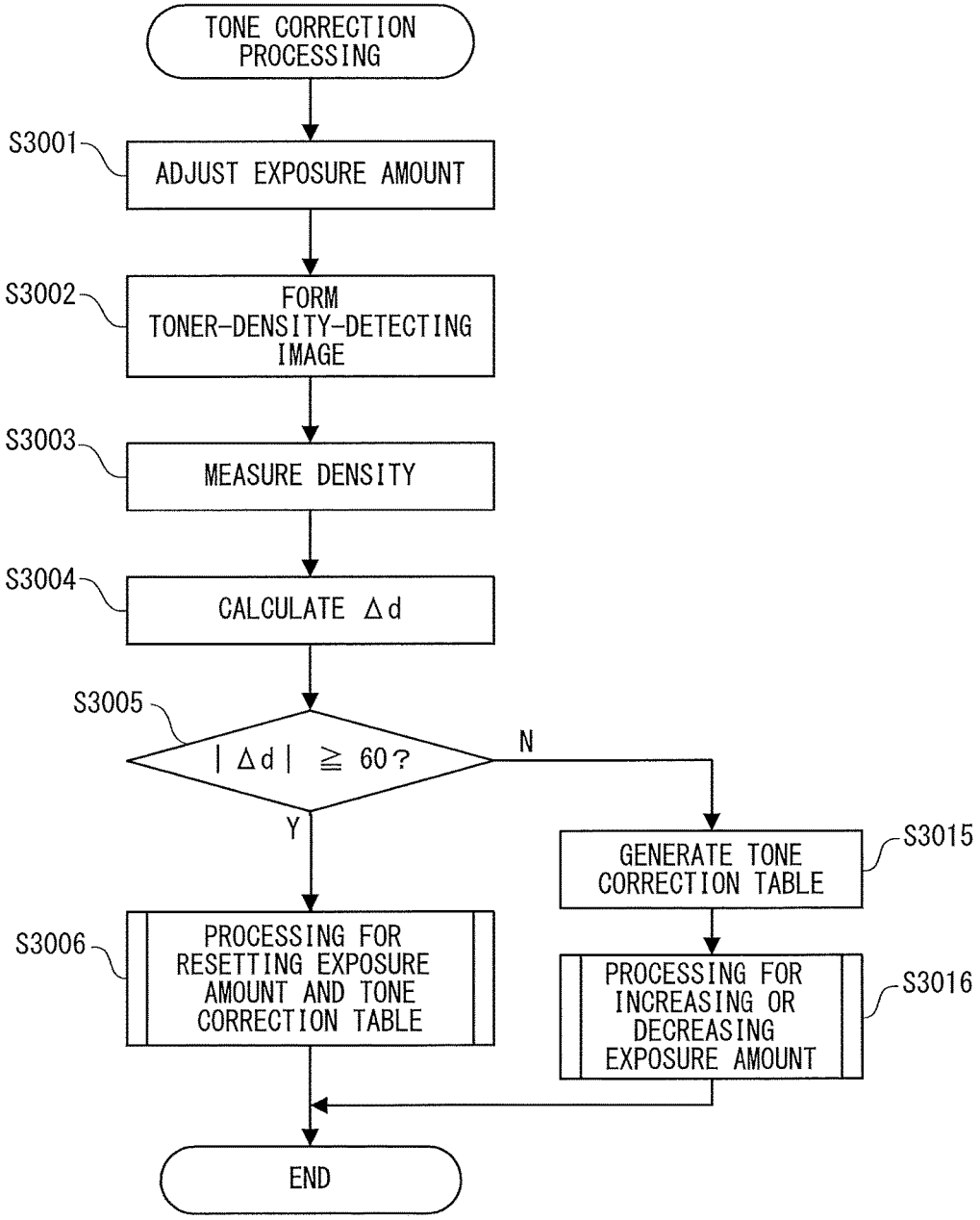
FIG. 6 is a flowchart for illustrating tone correction processing.

FIG. 6 is a flowchart for illustrating the tone correction processing.

The printer controller 109 causes the laser light amount control circuit 190 to adjust the exposure amount of the laser light output from the exposure device 3 based on an increase/decrease amount of the exposure amount obtained in the processing for increasing or decreasing the exposure amount, which is described later (Step S3001). The controller 110 and the printer controller 109 form the toner-density-detecting image illustrated in FIG. 5A on the photosensitive drum 1 (Step S3002). The toner-density-detecting image of FIG. 5A is formed, and thus a processing time period is shorter compared with the case of forming the toner-density-detecting image of FIG. 5B.

Figure 7:
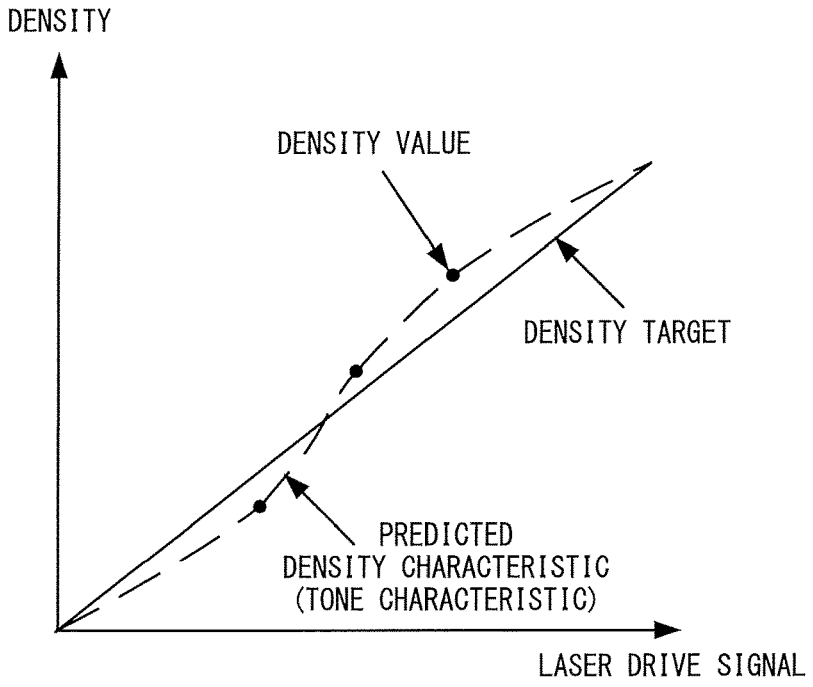
FIG. 7 is an explanatory graph of a predicted density characteristic (tone characteristic).

The image density sensor 12 detects the density of the toner-density-detecting image being the toner image formed on the photosensitive drum 1. The controller 110 acquires the measurement result of the density of the toner-density-detecting image from the image density sensor 12 (Step S3003). The controller 110 acquires the density value from the measurement result obtained by the image density sensor 12, and plots the density value with respect to a density target being a target density value set in advance, to thereby predict the density characteristic (tone characteristic). FIG. 7 is an explanatory graph of the predicted density characteristic (tone characteristic). The density target is indicated by the solid line. The density target is set so that a relationship between the laser drive signal and the density exhibits a linear function. The density characteristic (tone characteristic) predicted by plotting the density values is indicated by the broken line.

The controller 110 calculates a density difference Δd (=(Dmax portion density)−(highest density of density target)) between the measured density value of the Dmax portion being the highest density of the toner-density-detecting image of FIG. 5A and the highest density of the density target (Step S3004). In this case, the Dmax portion of the toner-density-detecting image corresponds to a third measurement image. The controller 110 determines whether or not the absolute value of the calculated density difference Δd is equal to or larger than "60" (Step S3005). When the absolute value is not equal to or larger than "60" (N in Step S3005), the controller 110 conducts inverse conversion processing so as to match the predicted density characteristic (tone characteristic) with the density target, and generates the tone correction table (Step S3015). The controller 110 stores the generated tone correction table in the γ-correction circuit 209. With this, the image data is subjected to tone correction, and normal image forming processing is conducted. After generating the tone correction table, the controller 110 conducts the processing for increasing or decreasing the exposure amount based on the density difference Δd calculated in the processing of Step S3004 (Step S3016), and brings the tone correction processing to an end. That is, the controller 110 generates the tone correction table based on the measurement result of the density of the toner-density-detecting image acquired in the processing of Step S3003 when the density difference Δd falls within a predetermined range (in this case, within a range of from −60 to +60). The controller 110 further sets the increase/decrease amount of the exposure amount in the laser light amount control circuit 190 based on the density difference Δd.

When the absolute value of the density difference Δd is equal to or larger than "60" (Y in Step S3005), the controller 110 conducts the processing for resetting the exposure amount and the tone correction table, which is described later, (Step S3006), and brings the tone correction processing to an end. That is, the controller 110 conducts the processing for resetting the exposure amount and the tone correction table when the density difference Δd falls out of the predetermined range (in this case, out of the range of from −60 to +60).

In short, the controller 110 controls whether or not to conduct the processing for resetting the exposure amount and the tone correction table based on the measurement result (density difference Δd) for the Dmax portion. When the density difference Δd falls out of the predetermined range, the controller 110 forms a Dmax-portion-adjusting image described later and the toner-density-detecting image illustrated in FIG. 5B. Meanwhile, when the density difference Δd falls within the predetermined range, the controller 110 skips the formation of the Dmax-portion-adjusting image and the toner-density-detecting image illustrated in FIG. 5B. Then, the controller 110 generates the tone correction table based on the measurement result of the toner-density-detecting image formed in Step S3002.

The density target is described. The density target is generated from a density value acquired by automatic tone correction control using an image formed on the recording material S, and is stored in the RAM 112. The automatic tone correction control is executed in response to an instruction issued through the operation unit 20 by the user.

When the execution of the automatic tone correction control is instructed, the image forming apparatus 100 causes the printer section B to form an image pattern having a large number of tone levels (in this case, 64 tone levels) on the recording material S for each color. The recording material S on which the image pattern has been formed is placed on the original table 102 of the reader A by the user. The reader A reads the image pattern from the placed recording material S. With this processing, the reader A detects the density value of the image pattern. A result of the detection is transmitted from the reader A to the controller 110 of the printer section B.

Figure 8:
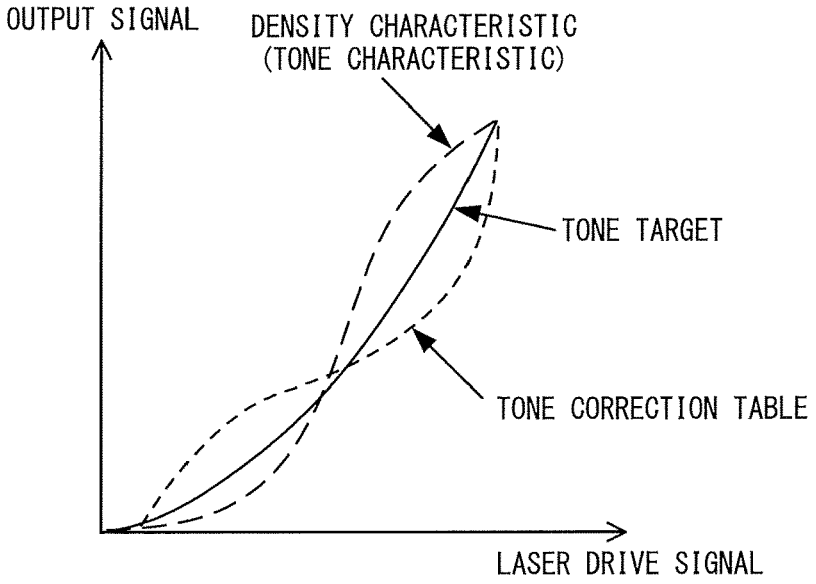
FIG. 8 is an explanatory graph of a tone correction table.

The controller 110 conducts storing processing and smoothing processing on the density value detected from the image pattern to acquire the density characteristic (tone characteristic) for an entire density region. The controller 110 generates the tone correction table for the image data based on the obtained density characteristic (tone characteristic) and a tone target set in advance. FIG. 8 is an explanatory graph of the tone correction table. The controller 110 conducts the inverse conversion processing on the density characteristic (tone characteristic) so that the density characteristic is matched with the tone target, to thereby create the tone correction table. The image data is corrected based on the tone correction table and subjected to the image forming processing, to thereby match the density of the image formed on the recording material S with the tone target over the entire density region.

The image forming apparatus 100 uses such a tone correction table to form the toner image having a plurality of image patterns on the photosensitive drum 1. The image density sensor 12 detects the density of the toner image having the image pattern formed on the photosensitive drum 1. The controller 110 can acquire a target density for the image data on the photosensitive drum 1 based on the density value representing the detected density of the toner image. In this embodiment, after creating the tone correction table, the controller 110 forms the toner-density-detecting image having ten tone levels illustrated in FIG. 5B on the photosensitive drum 1 to acquire the density target. The controller 110 stores the acquired density target in the RAM 112 to use the density target for the processing.

Processing for Increasing or Decreasing Exposure Amount

Figure 9:
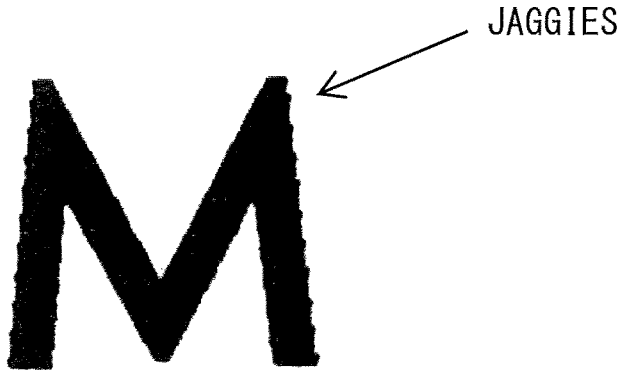
FIG. 9 is a diagram for exemplifying a character having jaggies.

When the density correction is conducted by only the tone correction, a portion of the image having the highest density may be excessively subjected to halftoning depending on the density characteristic (tone characteristic) of the image forming apparatus 100. In this case, jaggies occur in a character as exemplified in, for example, FIG. 9. Therefore, not only the tone correction table but also the adjustment of the exposure amount conducted by the exposure device 3 is important in order to ensure image quality. In this embodiment, the exposure amount is adjusted based on a result of the tone correction processing. Specifically, the controller 110 conducts the processing for increasing or decreasing the exposure amount based on the density difference Δd calculated in the processing of Step S3004 illustrated in FIG. 6 of the tone correction processing.

However, it is necessary to suppress an influence on the density of the image of the halftone portion due to the increase or decrease of the exposure amount. To that end, the increase/decrease amount of the exposure amount is determined based on the result obtained when the exposure amount is changed using a common correction table for each image forming apparatus.

Figure 10:
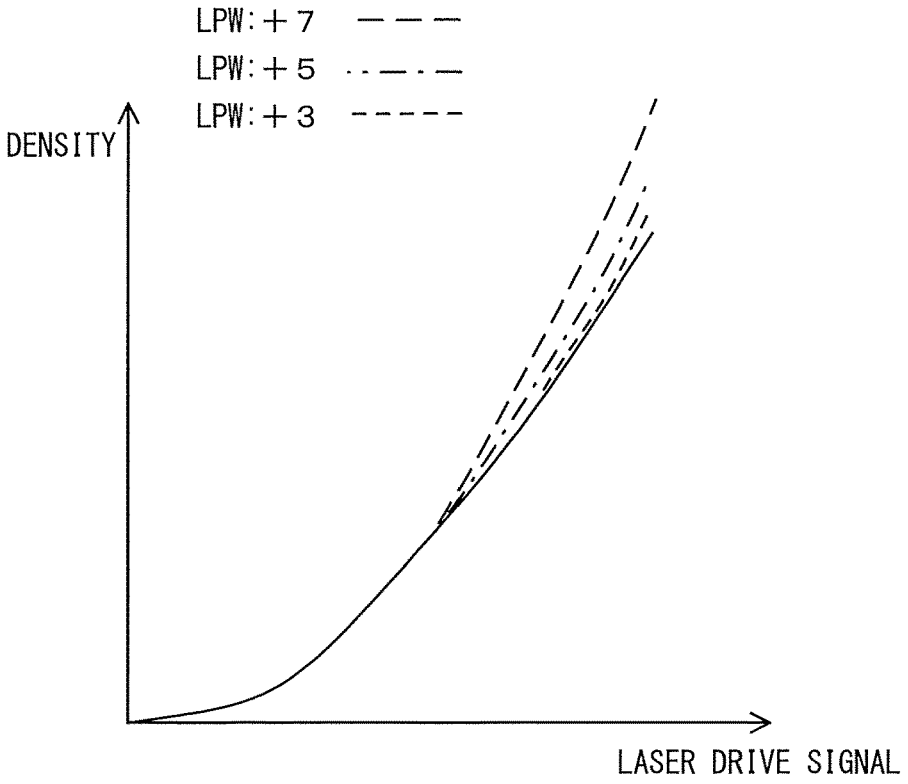
FIG. 10 is an explanatory graph of a change in density of a halftone portion.

FIG. 10 is an explanatory graph of a change in density of the halftone portion at the time of the increase or decrease of the exposure amount. When an exposure increase/decrease amount is large, the image forming apparatus 100 cannot correct the density of a halftone by the tone correction. Therefore, density deviation occurs in the halftone. In order to inhibit the density deviation from occurring in the halftone, the image forming apparatus 100 needs to maintain the exposure increase/decrease amount within such a range as to allow the halftone portion to be corrected by the tone correction. In this embodiment, as shown in FIG. 10, when the exposure amount level exhibits three levels within the 255 levels, it is possible to correct a halftone density by the tone correction. Therefore, in this embodiment, the maximum value of the increase/decrease amount of the exposure amount is set to ±3 levels.

Figure 11:
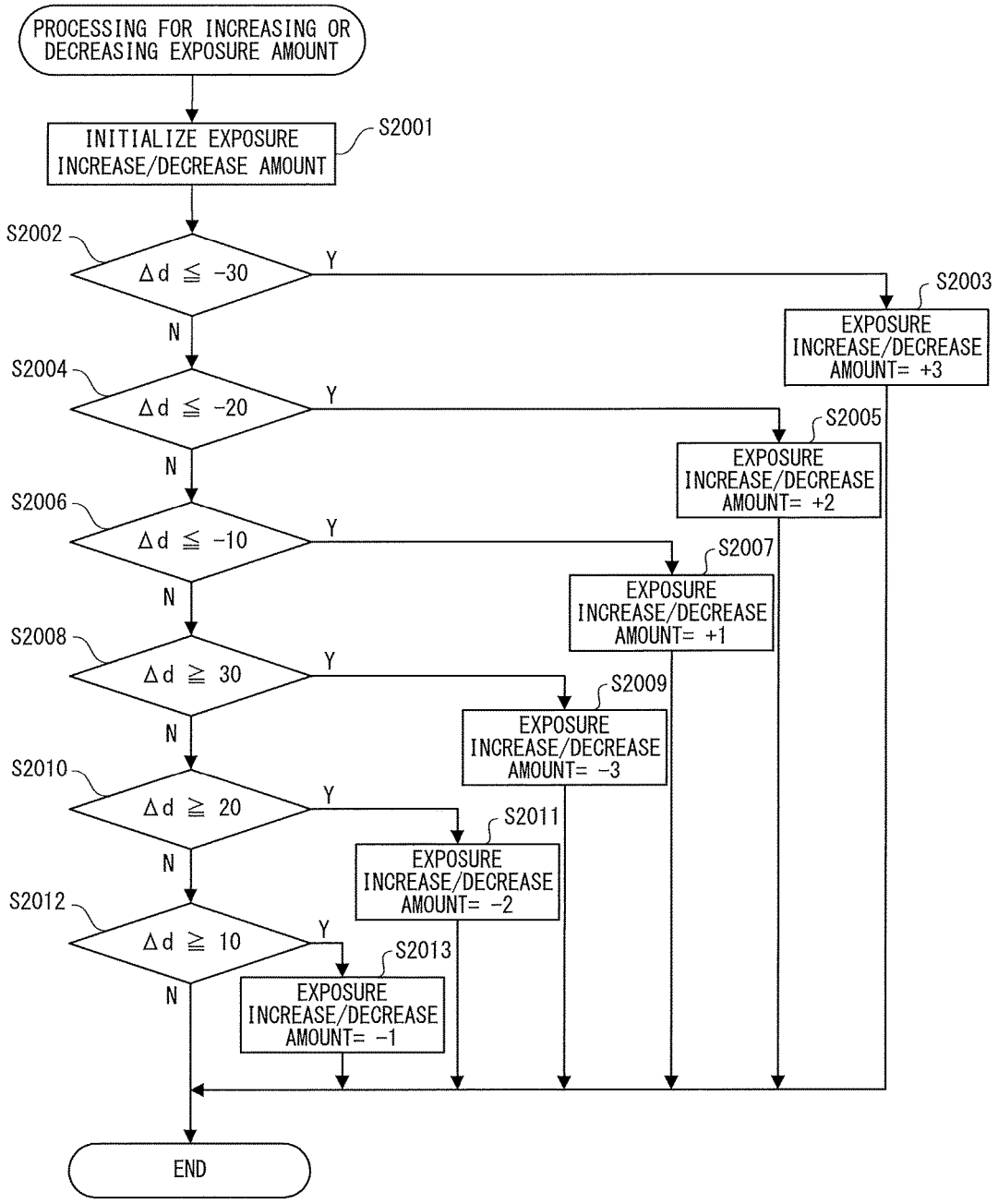
FIG. 11 is a flowchart for illustrating processing for increasing or decreasing an exposure amount.

FIG. 11 is a flowchart for illustrating the processing for increasing or decreasing the exposure amount. When the absolute value of the density difference Δd calculated in the processing of Step S3004 of the tone correction processing is not equal to or larger than "60", the controller 110 starts the processing for increasing or decreasing the exposure amount after generating the tone correction table (N in Step S3005 and Step S3015, which are illustrated in FIG. 6).

The controller 110 initializes the exposure increase/decrease amount being the increase/decrease amount of the exposure amount to "0" (Step S2001). The controller 110 determines whether or not the density difference Δd is equal to or smaller than "−30" (Step S2002). When the density difference Δd is equal to or smaller than "−30" (Y in Step S2002), the controller 110 determines that the measured density value of the toner-density-detecting image is extremely low with respect to the density target. In this case, the controller 110 sets the exposure increase/decrease amount to "+3" so that the density value becomes closer to the density target (Step S2003). When the density difference Δd falls within a range of from "−30" to "−20" (Y in Step S2004), the controller 110 sets the exposure increase/decrease amount to "+2" (Step S2005). When the density difference Δd falls within a range of from "−20" to "−10" (Y in Step S2006), the controller 110 sets the exposure increase/decrease amount to "+1" (Step S2007).

When the density difference Δd is equal to or larger than "+30" (Y in Step S2008), the controller 110 determines that the measured density value of the toner-density-detecting image is extremely high with respect to the density target. In this case, the controller 110 sets the exposure increase/decrease amount to "−3" so that the density value becomes closer to the density target (Step S2009). When the density difference Δd falls within a range of from "+20" to "+30" (Y in Step S2010), the controller 110 sets the exposure increase/decrease amount to "−2" (Step S2011). When the density difference Δd falls within a range of from "+10" to "+20" (Y in Step S2012), the controller 110 sets the exposure increase/decrease amount to "−1" (Step S2013).

The controller 110 sets the exposure increase/decrease amount in the laser light amount control circuit 190. The laser light amount control circuit 190 adjusts the exposure amount based on the set exposure increase/decrease amount before the toner-density-detecting image is formed next time the tone correction processing is executed (Step S3001 of FIG. 6). Therefore, the tone correction table is generated after the exposure amount is adjusted, and the density deviation is inhibited from occurring in the halftone portion. There may be employed a configuration for executing the tone correction processing illustrated in FIG. 6, for example, at a time of initial adjustment immediately after a main power source of the image forming apparatus 100 is turned on, and executing other tone correction processing while the image is being formed based on the image data. The other tone correction processing is, for example, processing for causing, after the measurement result of the density of the toner-density-detecting image is acquired in the processing of Step S3003 of FIG. 6, the controller 110 to execute the processing of Step S3015 and then execute the processing of Step S3016. According to this configuration, when the other tone correction processing is executed while the image formation is being conducted continuously, the image forming apparatus 100 can inhibit downtime. In addition, the exposure amount is not greatly changed, and hence a difference between the density of the image before the other tone correction processing is executed and the density of the image after the other tone correction processing is executed can be inhibited from increasing. The toner-density-detecting image formed in Step S3002 of the tone correction processing illustrated in FIG. 6 corresponds to a plurality of measurement images including the third measurement image. Meanwhile, the toner-density-detecting image formed in the other tone correction processing corresponds to other second measurement images. The types of densities of the plurality of measurement images of this embodiment include four measurement images having different densities. The toner-density-detecting image of this embodiment includes ten measurement images having different densities. While the image forming unit P is continuously forming a plurality of images, the controller 110 executes the other tone correction processing, and generates the tone correction table. In addition, the Dmax portion of the toner-density-detecting image formed in the other tone correction processing, which is illustrated in FIG. 5A, corresponds to a predetermined measurement image to be used for determining the image forming condition.

Processing for Resetting Exposure Amount and Tone Correction Table

In the above-mentioned processing for increasing or decreasing the exposure amount, adjustment can be conducted only within the range of ±3 levels at maximum due to the influence of the density of the halftone. However, when there is a great change in installation environment of the image forming apparatus 100, it may no longer be possible to form a desired image because the image density being the highest density cannot be optimized through the correction with ±3 levels at maximum irrespective of the large density difference Δd being the highest density. Therefore, when the density difference Δd falls out of the predetermined range, the image forming apparatus 100 resets the exposure amount and regenerates the tone correction table. In this embodiment, when the absolute value of the density difference Δd exceeds "60", the exposure amount is reset, and the tone correction table is regenerated.

Figure 12:
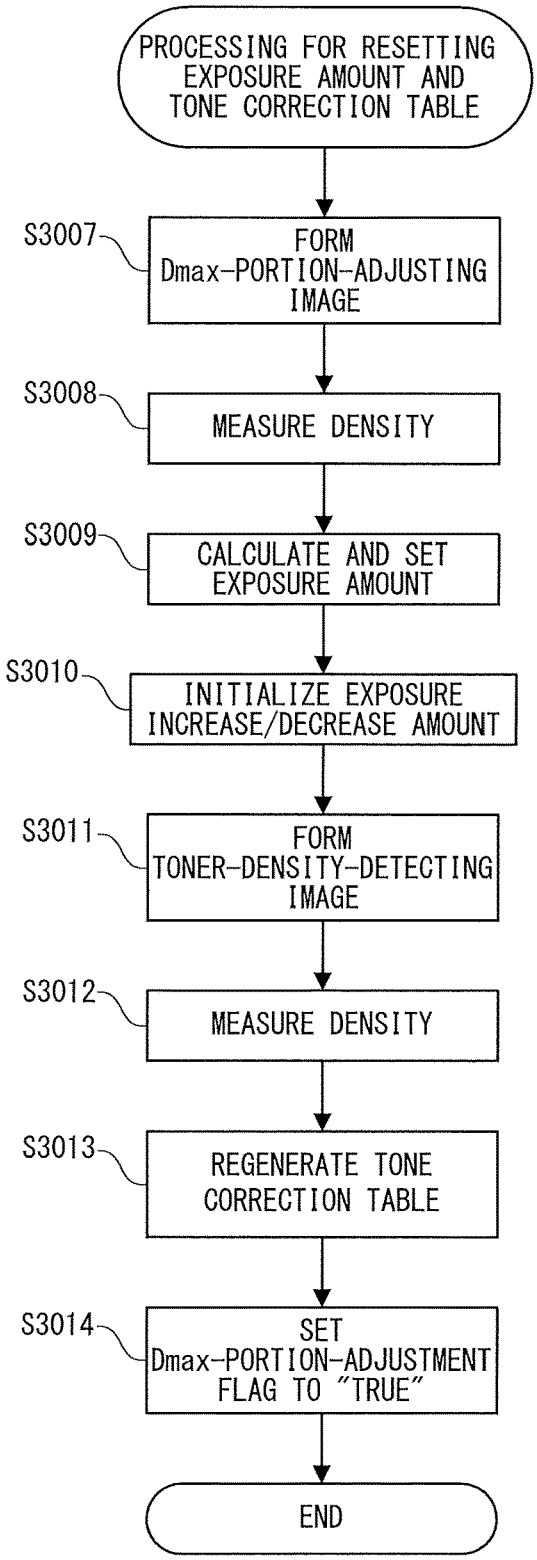
FIG. 12 is a flowchart for illustrating processing for resetting the exposure amount and a γ LUT.

FIG. 12 is a flowchart for illustrating processing for resetting the exposure amount and the tone correction table. When the absolute value of the density difference Δd calculated in the processing of Step S3004 of the tone correction processing is equal to or larger than "60", the controller 110 starts the processing for resetting the exposure amount and the tone correction table (Y in Step S3005 and Step S3006, which are illustrated in FIG. 6).

Figure 13:
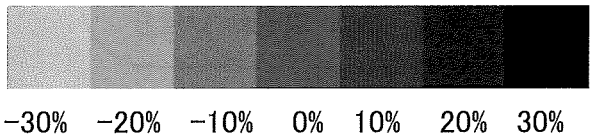
FIG. 13 is a diagram for exemplifying a Dmax-portion-adjusting image.
Figure 14:
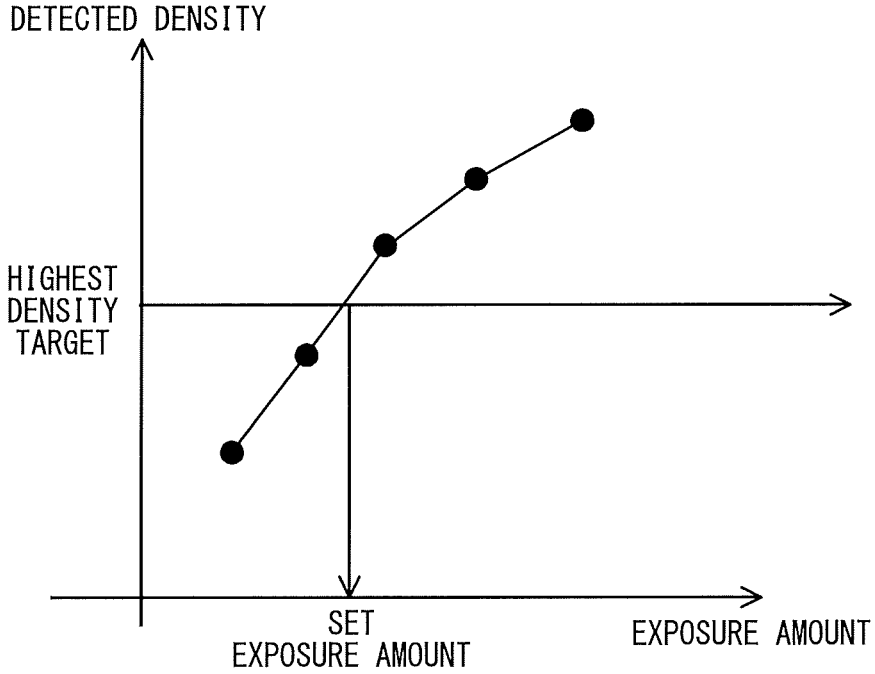
FIG. 14 is an explanatory graph of a relationship between the exposure amount and a density.

The controller 110 first resets the exposure amount. The controller 110 forms the Dmax-portion-adjusting image (first measurement image) being the measurement image exemplified in FIG. 13 on the photosensitive drum 1 (Step S3007). The Dmax-portion-adjusting image is an image to be used for adjusting the density of the Dmax portion being the highest density of the image. The Dmax-portion-adjusting image is formed of a measurement image exhibiting a plurality of exposure amounts including ±10%, ±20%, and ±30% with respect to the exposure amount (LPW_Ref) being a reference set at that point in time. The controller 110 acquires the measurement result of the density of the Dmax-portion-adjusting image detected by the image density sensor 12 (Step S3008). The controller 110 calculates the exposure amount corresponding to the density target by linear interpolation from a relationship between the exposure amount of the Dmax-portion-adjusting image and the measured density based on the acquired measurement result, and sets the calculated exposure amount (Step S3009). FIG. 14 is an explanatory graph of a relationship between the exposure amount of each measurement image of the Dmax-portion-adjusting image and the detected density. The controller 110 calculates a new exposure amount from such a relationship to set the new exposure amount. The controller 110, which has set the new exposure amount, initializes the exposure increase/decrease amount set in the processing for increasing or decreasing the exposure amount to "0" (Step S3010). The controller 110 thus brings the resetting of the exposure amount to an end. The exposure amount is an example of the image forming condition for adjusting the density of an output image to be formed on the recording material S by the image forming unit P. The image forming condition includes not only the exposure amount but also a charging voltage of the charger 2, a developing bias applied to the developing device 4, and a voltage applied at the primary transfer portion T1.

The controller 110, which has brought the resetting of the exposure amount to an end, conducts tone correction control in order to match the density of each tone level with the density target based on the new exposure amount. In this embodiment, the toner-density-detecting image exemplified in FIG. 5B is used to conduct the tone correction control.

The controller 110 forms the toner-density-detecting image of FIG. 5B (second measurement images) on the photosensitive drum 1 (Step S3011). The controller 110 acquires the measurement result of the density of the toner-density-detecting image detected by the image density sensor (Step S3012). The controller 110 detects the density characteristic (tone characteristic) by conducting the linear interpolation on discrete density values of the toner-density-detecting image corresponding to ten tone levels. The controller 110 regenerates the tone correction table by conducting the inverse conversion processing on the detected density characteristic (tone characteristic) so as to match the density characteristic (tone characteristic) with the density target (Step S3013). The newly regenerated tone correction table is stored in the γ-correction circuit 209. The controller 110, which has regenerated the tone correction table, sets a Dmax-portion-adjustment flag for the low-speed mode to "True" (Step S3014).

The Dmax-portion-adjustment flag for the low-speed mode is a flag to be used for adjusting the Dmax portion being the image having the highest density when a print job is started with the process speed being set to the low-speed mode. In a case where the process speed is set to the low-speed mode when the Dmax-portion-adjustment flag is "True", the controller 110 conducts the adjustment of the Dmax portion. When the absolute value of the density difference Δd is equal to or larger than "60" in the processing of Step S3005 illustrated in FIG. 6, the controller 110 determines that the Dmax portion being the image having the highest density needs to be adjusted. In the low-speed mode, the image density being the highest density is highly liable to greatly differ from an ideal density. Therefore, it is necessary to reset the exposure amount even in the low-speed mode.

Figure 15:
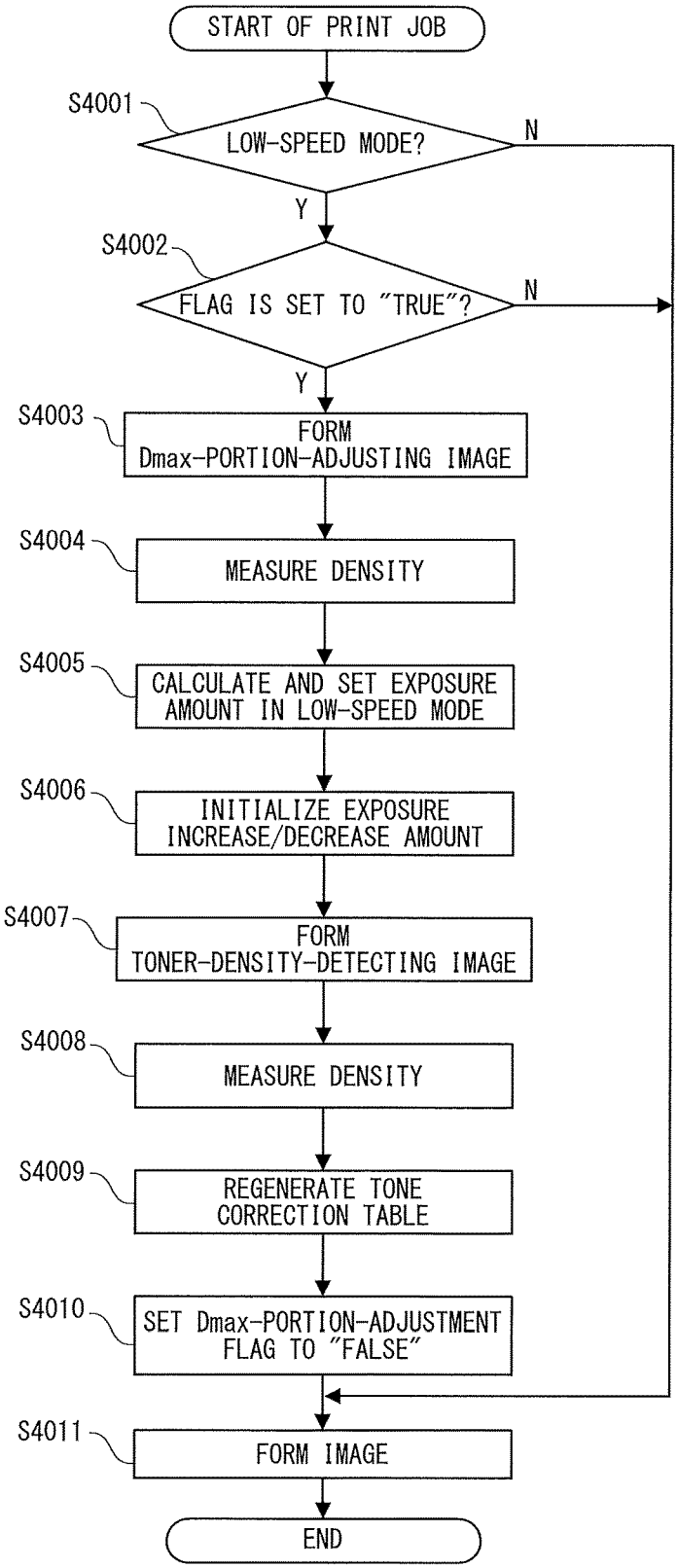
FIG. 15 is a flowchart for illustrating processing conducted in a case where a print job is executed.

FIG. 15 is a flowchart for illustrating processing conducted when the print job is executed with the process speed being set to the low-speed mode.

The controller 110 examines the process speed of the print job to be started (Step S4001). When the process speed is set to the constant-speed mode (N in Step S4001), the controller 110 conducts the image forming processing without resetting the exposure amount and the tone correction table (Step S4011). When the process speed is set to the low-speed mode (Y in Step S4001), the controller 110 examines whether or not the Dmax-portion-adjustment flag for the low-speed mode is "True" (Step S4002). When the Dmax-portion-adjustment flag for the low-speed mode is "False" (N in Step S4002), the controller 110 conducts the image forming processing without resetting the exposure amount and the tone correction table (Step S4011).

When the Dmax-portion-adjustment flag for the low-speed mode is "True" (Y in Step S4002), the controller 110 adjusts the Dmax portion in the low-speed mode. The controller 110 first forms the Dmax-portion-adjusting image being the toner-density-detecting image exemplified in FIG. 13 on the photosensitive drum 1 (Step S4003). The controller 110 acquires the measurement result of the density of the Dmax-portion-adjusting image detected by the image density sensor 12 (Step S4004). The controller 110 calculates the exposure amount corresponding to the density target by linear interpolation from a relationship between the exposure amount of the Dmax-portion-adjusting image and the measured density based on the acquired measurement result.

The controller 110 sets the calculated exposure amount in the laser light amount control circuit 190 as the exposure amount in the low-speed mode (Step S4005). The controller 110, which has set the exposure amount in the low-speed mode, initializes the exposure increase/decrease amount set in the processing for increasing or decreasing the exposure amount to "0" (Step S4006).

Subsequently, the controller 110 forms the toner-density-detecting image of FIG. 5B on the photosensitive drum 1 (Step S4007). The controller 110 acquires the measurement result of the density of the toner-density-detecting image detected by the image density sensor 12 (Step S4008). The controller 110 detects the density characteristic (tone characteristic) by conducting the linear interpolation on the discrete density values of the toner-density-detecting image corresponding to ten tone levels. The controller 110 regenerates the tone correction table by conducting the inverse conversion processing on the detected density characteristic (tone characteristic) so as to match the density characteristic (tone characteristic) with the density target (Step S4009). The newly regenerated tone correction table is stored in the γ-correction circuit 209. The controller 110, which has regenerated the tone correction table, sets the Dmax-portion-adjustment flag for the low-speed mode to "False" (Step S4010). The controller 110 uses the regenerated tone correction table to conduct the image forming processing (Step S4011).

The image forming apparatus 100 described above can optimally adjust the density of the image having the highest density by appropriately conducting the adjustment, that is, the increase or decrease, of the exposure amount and the tone correction. Therefore, the image forming apparatus 100 can form an image with a satisfactory density even when the density deviation becomes larger due to a great change in installation environment or the like. That is, the image forming apparatus 100 sets the conversion condition and the image forming condition based on different toner images depending on the density difference from the toner image having the highest density, to thereby be able to suitably adjust a density while following even great environmental variations.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2016-137227, filed Jul. 12, 2016 which is hereby incorporated by reference herein in its entirety.

What is claimed is:

1. An image forming apparatus, comprising:

a converter configured to convert image data based on a conversion condition;

an image bearing member;

an image forming unit configured to form an image on the image bearing member based on the image data converted by the converter;

a transfer portion at which the image is transferred from the image bearing member to a sheet;

a measuring unit configured to measure a measurement image on image bearing member; and a controller configured to:

(1) control the image forming unit to form a plurality of first measurement images on the image bearing member;

(2) control the measuring unit to measure the plurality of first measurement images;

(3) control whether or not to form a plurality of second measurement images based on a measurement result of the plurality of first measurement images measured by the measuring unit;

(4) generate, in a case where the plurality of second measurement images are not formed, the conversion condition based on the measurement results of the plurality of first measurement images measured by the measurement unit; and (5) generate, in a case where the plurality of second measurement images are formed, the conversion condition based on the measurement results of the plurality of second measurement images measured by the measurement unit, the plurality of second measurement images being formed under an adjusted image forming condition, wherein the adjusted image forming condition is adjusted based on the measurement results of other measurement images measured by the measuring unit, and the other measurement images are formed by the image forming unit before the image forming unit forms the plurality of second measurement images.

2. The image forming apparatus according to claim 1, wherein the controller controls the image forming unit to form the plurality of first measurement images in a case where a main power source of the image forming apparatus is turned on.

3. The image forming apparatus according to claim 1, wherein a number of tone levels of the plurality of second measurement images is larger than a number of tone levels of the plurality of first measurement images.

4. The image forming apparatus according to claim 1, wherein, in a case where a difference between a measurement value of a predetermined measurement image of the plurality of first measurement images and the target value is within a predetermined range, the controller does not form the plurality of second measurement images.

5. The image forming apparatus according to claim 1, wherein, in a case where the plurality of second measurement images are not formed, the controller determines an image forming condition based on a measurement result of a predetermined measurement image of the plurality of first measurement images, and wherein the controller controls, in a case where the image forming unit forms a plurality of first measurement images in a next time, the image forming unit based on the determined image forming condition.

6. The image forming apparatus according to claim 1, wherein:

the image bearing member includes a photosensitive member;

the image forming unit includes an exposure unit configured to expose the photosensitive member to form an electrostatic latent image, and a developing unit configured to develop the electrostatic latent image on the photosensitive member; and the image forming condition includes an exposure amount of light from the exposure unit.

7. An image forming apparatus, comprising:

a converter configured to convert image data based on a conversion condition;

an image bearing member;

an image forming unit, which is controlled based on an image forming condition, the image forming unit being configured to form an image on the image bearing member based on the image data converted by the converter;

a transfer portion at which the image is transferred from the image bearing member to a sheet;

a measuring unit configured to measure a measurement image on the image bearing member; and a controller configured to:

(1) control the image forming unit to form measurement images, each of the measurement images having a different density from each other, wherein each of the measurement images includes a predetermined measurement image;

(2) control the measurement unit to measure the measurement images on the image bearing member;

(3) control, based on a measurement result of the predetermined measurement image measured by the measurement unit, a determination as to whether or not to form a reference measurement image which is used for adjusting the image forming condition;

(4) in a case where the reference measurement image is formed by the image forming unit, (a) control the measurement unit to measure the reference measurement image on the image bearing member, (b) adjust the image forming condition based on a measurement result of the reference measurement image measured by the measurement unit, (c) control the image forming unit to form other measurement images, each of the other measurement images having a different density from each other, (d) control the measurement unit to measure the other measurement images on the image bearing member, and (e) generate the conversion condition based on the measurement results of the other measurement images measured by the measurement unit; and (5) in a case where the reference measurement image is not formed, generate the conversion condition based on measurement results of the measurement images measured by the measurement unit.

8. The image forming apparatus according to claim 7, wherein the controller controls the image forming unit to form the measurement images in a case where a main power source of the image forming apparatus is turned on.

9. The image forming apparatus according to claim 7, wherein a number of tone levels of the other measurement images is larger than a number of tone levels of the measurement images.

10. The image forming apparatus according to claim 7, wherein, in a case where a difference between a measurement value of the predetermined measurement image and a target value is within a predetermined range, the controller does not form the other measurement images.

11. The image forming apparatus according to claim 7, wherein:

the image forming unit includes a light source configured to emit a light to form an electrostatic latent image; and the image forming condition includes a light amount of the light source.

* * * * *